United States Patent [19]

Mitchell

[11] 3,952,437

[45] Apr. 27, 1976

[54] PICTURE FRAME CONSTRUCTION

[75] Inventor: Robert W. Mitchell, Saint Joseph, Mich.

[73] Assignee: Photo Systems, Inc., Ann Arbor, Mich.

[22] Filed: Apr. 5, 1974

[21] Appl. No.: 458,087

[52] U.S. Cl. ..... 40/152.1

[51] Int. Cl.[2] ..... G09F 1/12

[58] Field of Search..... 40/124.1, 126 A, 10, 40/152.1, 132 A; 161/13, 14; 229/8, 23 R; 220/4 R

[56] References Cited

UNITED STATES PATENTS

| | | | |
|---|---|---|---|
| 2,644,935 | 7/1953 | Greenwald | 40/132 R |
| 2,731,748 | 1/1956 | Polay | 40/155 |
| 2,854,774 | 10/1958 | Horwitt | 40/155 |
| 3,116,027 | 12/1963 | Kleppin | 40/132 R |
| 3,517,905 | 6/1970 | Nestegard | 248/469 |
| 3,711,975 | 1/1973 | Downing | 40/10 R |
| 3,841,009 | 10/1974 | Mohrlock | 40/126 A |

FOREIGN PATENTS OR APPLICATIONS

| | | | |
|---|---|---|---|
| 603,388 | 6/1958 | United Kingdom | 206/805 |
| 545,040 | 2/1956 | Belgium | 40/132 R |

*Primary Examiner*—Louis G. Mancene
*Assistant Examiner*—Wenceslao J. Contreras
*Attorney, Agent, or Firm*—Neuman, Williams, Anderson & Olson

[57] ABSTRACT

A display frame construction employs spaced end plates having at least two contiguous curved edges to receive at least two webs or sheets carrying graphic displays. Interposed slotted spacer members which interfit with and maintain the plates in spaced generally parallel relation may be employed to receive the contiguous edges of the displays. Edge portions of the plates are also slotted along the curved edges whereby two opposed edges of a rectangular picture or other display web may be received in plate slots which follow the edge contours of the plates and the other pair of opposed edges of the display may be received in the slots of the spacer means. The plates and spacers may interlock or resilient means between the plates may be employed to maintain the frame components in a state of assembly.

14 Claims, 12 Drawing Figures

FIG. 1
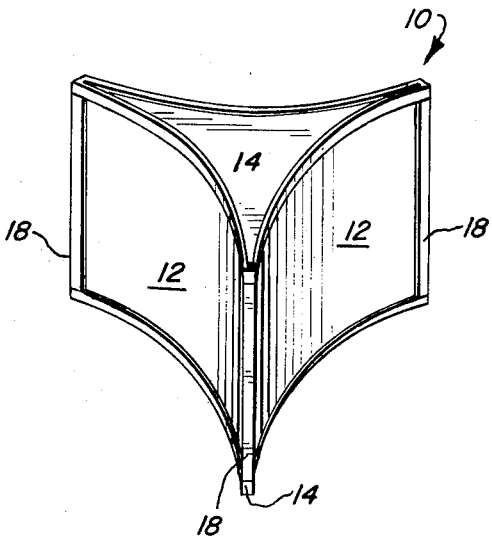
FIG. 2
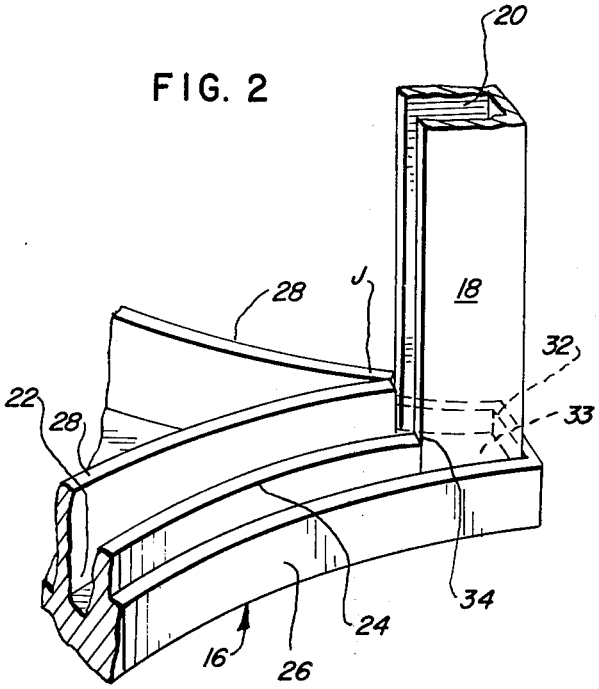
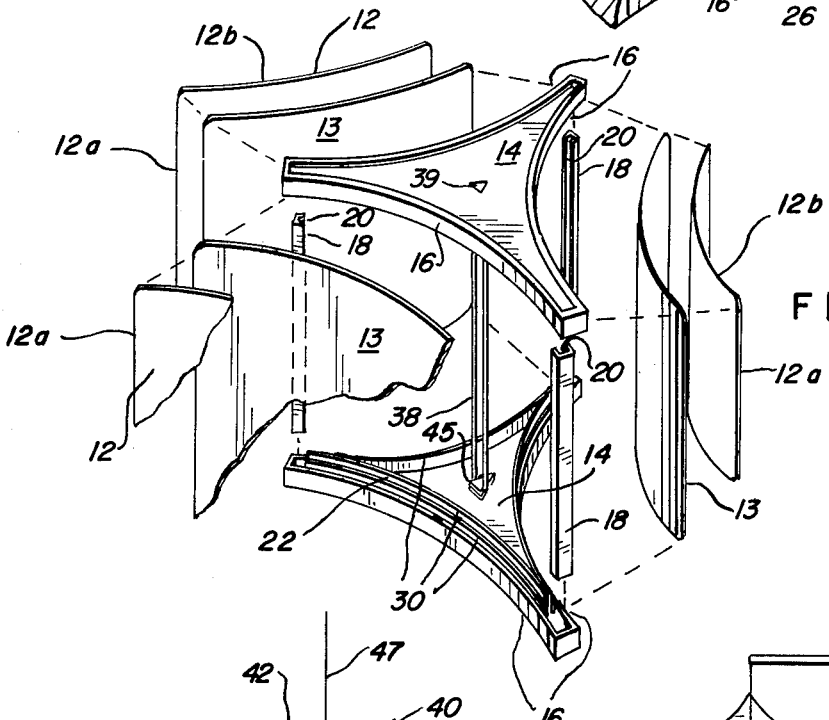
FIG. 3
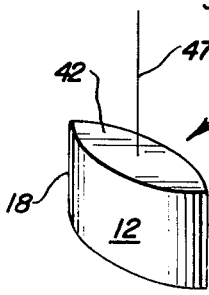
FIG. 5
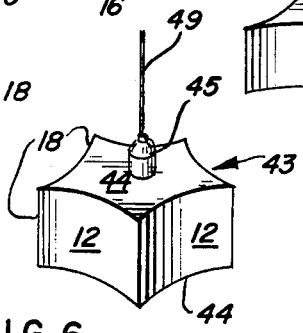
FIG. 6
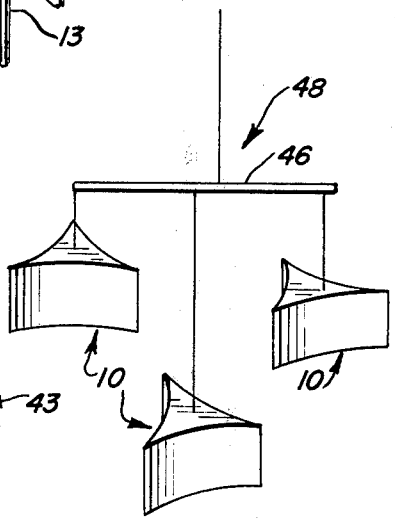
FIG. 7

FIG. 4
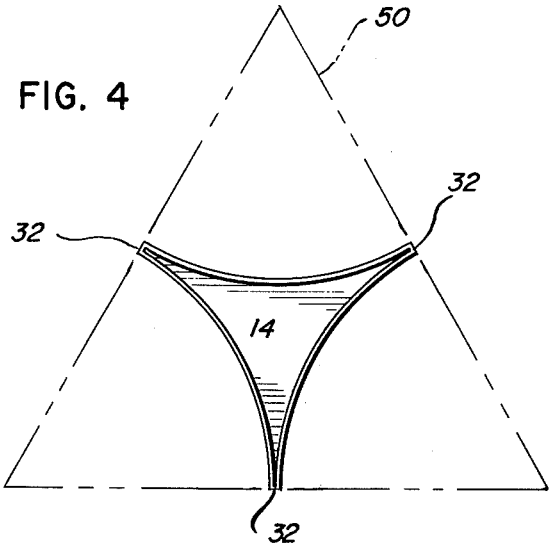
FIG. 8
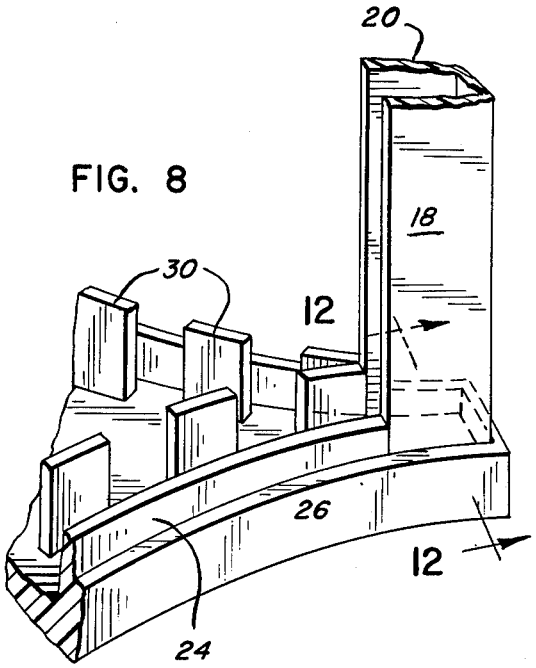
FIG. 9
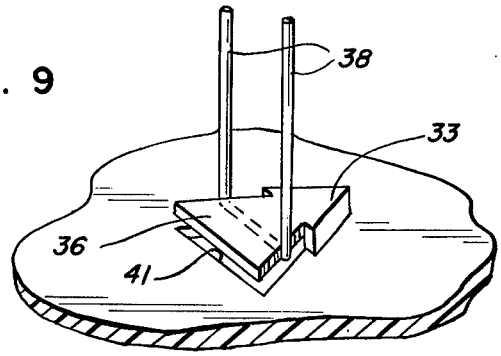
FIG. 10
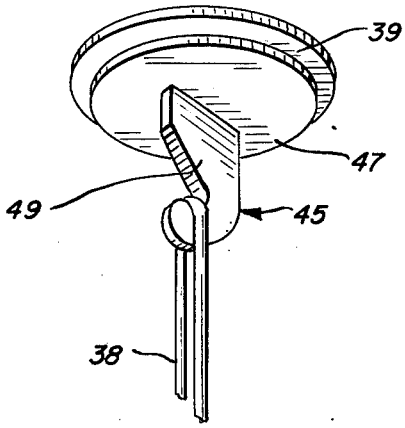
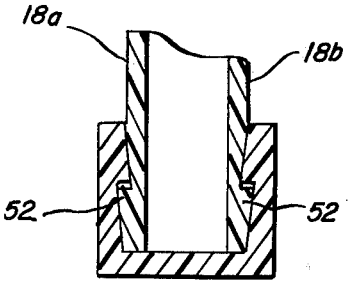
FIG. 12
FIG. 11
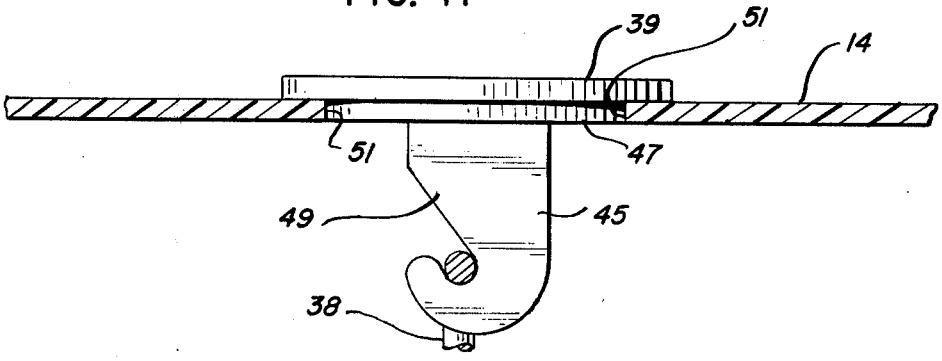

PICTURE FRAME CONSTRUCTION

BRIEF SUMMARY OF THE INVENTION

This invention relates to a novel frame construction for photographs or other displays which enables pictures to be taken directly from the dark room or photofinishers and captured in an attractive curved position in a permanent display. The frame thus dispenses with conventional flat frames, cover-glass and the difficulties involved in attempting to dry mount pictures in a flat condition.

The usual flat-mounted picture is normally eye-appealing only to the extent that the particular subject matter of the picture is of interest to the viewer. The frame is normally plain or of a character to blend with the room furnishings. It is not itself an art form.

OBJECTS OF THE INVENTION

It is an object of this invention to provide a picture frame construction or similar graphic display structure in which pictures may be mounted in a variety of curved shapes so as to produce various visual effects. Thus a wide angle effect may be obtained by mounting elongate photographs concavely and contiguously in a frame comprising one embodiment of this invention. A very different visual effect is obtained by mounting photographs convexly and contiguously in another embodiment of this invention.

It is a further object of this invention to provide a versatile frame construction composed of a minimum number of parts which may readily be assembled and disassembled for display insertion and replacement, function as an attractive mobile, or as an eye-catching lighted display.

DESCRIPTION OF THE DRAWINGS

For a more complete understanding of this invention reference will now be made to the drawings wherein:

FIG. 1 comprises a perspective view of a display frame made in accordance with this invention, adapted to hold three displays in a concave relationship;

FIG. 2 is an enlarged fragmentary perspective view illustrating the interfitting relation between spacer and plate elements of a frame construction made in accordance with this invention;

FIG. 3 is a fragmentary exploded view of a frame of FIG. 1 and the picture and backing members to be mounted therein;

FIG. 4 is a diagrammatic representation of a manner for determining edge curvature in a frame of this invention;

FIGS. 5 and 6 are illustrative of embodiments of picture frames which may be made pursuant to the invention;

FIG. 7 is a perspective view of a mobile which may be formed employing three of the frame constructions of FIG. 1;

FIG. 8 is a perspective view similar to FIG. 2 illustrating tooth-like projections which may be employed in a modified picture receiving slot employed in a frame made in accordance with this invention;

FIG. 9 is a fragmentary perspective view of a hook construction which may be employed with a resilient member for retaining the frame components together;

FIG. 10 is a perspective view of a modified "button" hook construction which may be employed in the frame of this invention;

FIG. 11 is an elevational view partly in section of the modified hook construction of FIG. 10 illustrated in the seated position in a plate; and FIG. 12 is a fragmentary view of one corner of an alternate embodiment of the invention showing a modification of the embodiment of FIG. 5 and taken on line 12—12 thereof.

DETAILED DESCRIPTION

Referring now to the drawing and more particularly to FIG. 1, a perspective view of a novel frame construction 10 is illustrated in which concavely curved rectangular displays 12—12 are mounted.

In the display frame construction, three displays 12—12 such as photographs are mounted in a trilateral cylindrical configuration with each side being concave. The adjacent edges of each pair of display sheets 12—12 are contained within a channel shaped spacer 18—18 and the ends are closed with matching end plates 14 having congruent edge slots to receive the concave edges of the display sheets 12—12.

While the major portion of this description will be devoted to the embodiment having three concave faces, it will be apparent in the light of this teaching that the invention can be practiced with convex surfaces and that two or more surfaces can be included as will be described in greater detail with respect to FIGS. 5–7.

It is essential to the invention that each display be shaped into a smooth cylindrical configuration to optimize the inherent strength of a cylindrical sheet as well as to enhance the appearance of the assembly and the smoothness of each display.

It will be more clearly seen from the exploded view of FIG. 3 that the frame 10 comprises two spaced plates 14—14 having shaped edges 16—16. Three identical spacers 18—18 comprising slotted channel-like members are adapted to maintain the plates 14—14 in parallel spaced relation as well as to retain the displays 12—12 as shown in FIG. 1. It will be more clearly seen from FIG. 2 that each spacer 18 is of substantially U-shaped cross-sectional configuration to receive a vertical edge of the pictures 12 illustrated in FIGS. 1 and 3 within longitudinal slot 20.

When the frame-picture assembly is in a position where one of the plates 14 rest on a horizontal surface, slots 20 receive the vertical picture edges 12*a*, whereas the parallel horizontal edges 12*b* of the pictures 12 are received in slot-defining portions of the edges 16—16 of plates 14—14. When the edges 12*b* are referred to as parallel edges it means they lie in parallel planes. It will be seen from FIG. 2 that a picture receiving slot 22 is formed in plate 14 between an outer wall portion 24, formed integrally with an outer halfwall 26, and inner rib 28. The greater height of rib 28 in comparison with wall portion 24 facilitates the insertion of display edge 12*b* in slot 22. The plates with integral ribs are preferably injection molded of a plastic such as polypropylene, although other materials may be employed including a variety of metals which may be cast, casting resins and woods which may be shaped by cutting tools. To facilitate the formation of dies employed in plastic molding and the overall molding operation, the continuous rib 28 illustrated in FIG. 2 may be replaced by the spaced tooth-like projections 30 illustrated in the plate of FIG. 8. The teeth 30 in conjunction with the wall portion 24 will serve to engage and retain the edge portion 12*b*.

The underside of the upper plate 14 is the mirror image of the top surface of the lower plate, the undersurface of the latter being substantially identical to the illustrated surface of the upper plate 14 in FIG. 3. The enlarged view of FIG. 2 illustrates V-shaped juncture J at the termini of the ribs 28—28. The juncture J is predeterminately spaced from an end wall 32, which in combination with the termini 34 of the outer slot walls 24 defines a rectilinear socket 33 adapted to snugly receive the end of a slotted spacer 18.

The displays 12 are preferably set in the lower slots 22 as a first step of assembly. As the preferred second step the three spacers 18—18 are inserted in the sockets 33—33 of a lower plate 14 having the slots 22 disposed upwardly as seen in FIG. 3, with the spacer slots 20 opening toward the plate center and engaging the edges 12*a* of displays 12—12. The upper plate which is similar to that illustrated in FIG. 2, is then manipulated to fit the upper ends of the spacers 18 into the end sockets in upper plate 14 as the displays 12 are fitted into slots 22 of the same plate. Backing sheets 13 may be employed with the displays 12 and fitted together into each of the slotted portions of plates 14—14. The sheets 13 may be of cardboard or plastic sheet material, are of the same dimensions as the displays and function as reinforcements if needed. The sheets 13 have their edges received in the plate slots 22 and spacer slots 20 in the same manner as the displays 12.

The relative dimensions of the spacer ends and the plate sockets, together with the resilient nature of the plastic or other material of fabrication, may provide a socket friction fit capable of maintaining all of the components of FIG. 3 assembled. As such a frictional assembly might be subject to accidental disassembly, a hook-like projection, such as projection 36 illustrated in FIG. 9, may be disposed in the facing central portions of the opposed plates 14—14 and resilient means, such as a rubber band 38 or the like, disposed therebetween to urge the plates 14—14 together and thus insure the integrity of the assembly. Projections 36 may comprise small equilateral triangular depressions in the top and bottom plate members 14 completely severed from the main plate web along one edge and most of the two straddling side edges to define opening 41. In a typical construction, connecting legs 33 would be only ⅛ inch in height. Such a configuration facilitates molding and avoids the necessity of auxiliary mold parts, sliding cores or the like.

As an alternative, "button" hooks 45 illustrated in FIGS. 10 and 11 may be employed. Each button hook 45 has an inwardly extending hook portion 49 received in a central aperture 51 in plate 14; see FIG. 11. Hook portions 49 are attached to button portions 47 which are formed integrally with enlarged flange 39. The button 47 snaps into the plate aperture 51 in which it is snugly received, and flange 39 functions as a button-positioning stop. The rubber band engagement with the hooks must, of course, be effected before the last picture is placed in position or before the top plate 14 is released to assume its final position.

If the hooks and resilient retainer 38 are omitted it is desirable to provide some other means for insuring the structural integrity of the assembly. This may be done by providing a positive interlock between the spacers 18—18 and the end plates 14—14. For example, as shown in FIG. 12, the spacers 18 may be molded with a slightly protuberant edge or latch 52 which will snap into corresponding recesses 54 formed in the inner surfaces of the walls 26. Thus when the spacers 18 and plates 14 are urged together, the two legs 18*a* and 18*b* of the channel-shaped spacer 18 will be urged outwardly somewhat so that the latch portions 52 will snap into recesses 54 and lock in place.

As mentioned above, the shaped edges of the frame plates 14—14 may differ from illustrated edges 16 of FIGS. 1 through 3. The plate edges may be convex rather than concave so as to provide a frame assembly 40 such as illustrated in FIG. 5 in which each plate 42 has two or more opposed convex edges or at least convex slots for receiving displays 12—12. Spacers 18—18 may be included in the convex configuration if desired.

FIG. 6 illustrates a frame assembly 43 having opposed plates 44, each of which possesses five concave edge portions. If desired the plates 44 could actually assume any desired shape such as circular or a conventional pentagon, provided the slots therein are appropriately configured to produce the smoothly curved cylindrical shape.

The embodiments of FIGS. 5 and 6 are shown suspended from cords 47 and 49 respectively. Each of the embodiments may rest as shown engage one plate 14 or 44 on a table or similar horizontal surface. Also each embodiment may be suspended from a cord as shown. Interesting and artistic effects are also obtained by resting two of the spacers 18—18 on a table so that the end plates 14—14 or 44—44 are vertical.

Furthermore, as shown in FIG. 6, the displays 12—12 may be transparencies in which case the cord 49 may be an electric cord which is connected to a light socket 45 supporting a small light source within the display frame 43. The particular plate edge configuration employed is a matter of choice. One manner of arriving at a desired concave edge curvature is illustrated in FIG. 4. A plate 14 having the three corners 32 thereof arranged in the desired equi-spaced relation would lie on a circle drawn therethrough, and an equilateral triangle 50 is drawn tangent to the circle at the three corners 32. The arc defined by a radial arm centered in each triangle corner and bisecting the adjacent triangle walls will define the pleasing curvature of edges 16 of the drawing and result in the edges 12*a* of adjacent displays meeting generally tangentially.

The pleasing concave curvature of a picture mounted in a frame such as that of FIG. 1 provides an extended picture or wide angle effect to the eye of the viewer. *

* Furthermore the cylindrical configuration provides enhanced strength, especially in compression to provide a surprising rigid assembly.

Knowing the width (or horizontal edge length) of the photographs 12 in FIG. 3, the radius of curvature of the shaped edges 16 may be determined as follows:

It will be noted from FIG. 4 that the concave curved edges comprise arcs which subtend 60° angles and thus comprise one-sixth of a total circumference. Since the width of the photographs 12 are coextensive with the edges 16, the total circumference of the circle made up of the curved edge is six times the photograph width. Since the circumference of a circle equals $2\pi r$, $r$, illustrated in FIG. 4, = circumference/$(2\pi)$. Thus, the edges 26 in the frame 10 are drawn along a radius equal to 6 times the width of the photographs 12, divided by $2\pi$.

The versatility of the frames of this invention is evident from FIG. 7 in which the frames 10 of FIG. 1 may be arranged on a supporting bar 46 to form a mobile 48.

As described above, the frames may also be employed to mount transparencies with light diffusing sheets replacing the stiffeners 13 and a light source mounted in the frame center.

The frame constructions of this invention are adaptable to a variety of decorative and functional uses all of which are appealing to the eye of the viewer.

The frames may be employed to mount any size photographs, including the small wallet size photographs which may be utilized as desk ornaments or the like. Larger size photographs readily lend themselves to advertising displays located in stores and other business establishments.

I claim:

1. A display frame construction for supporting a plurality of display sheet means, each sheet having opposed, generally parallel edges, said frame comprising opposed plates having respective slot-defining portions which follow the contour of the plate edges and define closed congruent slot patterns, each of said slot patterns having arcuate portions receiving one of said opposed edges, and retractable means urging said plates toward one another and against said edges to entrap the display sheet means therebetween whereby said retractable means is operatively connected to each of said plates and maintains said plates in spaced, generally parallel relationship with said display means lockingly disposed therebetween to form a display assembly having a cylindrical surface portion; said sheet means comprising a plurality of adjacent display sheet means abutting along edges generally normal to said plates to form a closed cylindrical display.

2. The frame construction of claim 1 including a plurality of channel shaped spacer means extending between said plates, one of said channel means receiving and retaining each pair of abutting edges of adjacent display sheet means.

3. In combination, opposed shaped plates having at least two curved edges and slot-defining edge portions adapted to receive opposed edges of a display sheet mounted between said plates, said slot-defining edge portions terminating in sockets, each socket being disposed at the juncture of slot-defining portions of contiguous edges of said plates, spacer means having end portions snugly received in said sockets and interposed between said plates so as to maintain the same in desired spaced relation, each of said spacer means having a slotted edge communicating with the slots of said plates whereby a display sheet mounted in said frame may have one pair of opposed edges engaging said plate slots and the second pair of opposed edges engaging the slots of said spacer means.

4. The combination of claim 3 in which the display sheet has a rectilinear periphery having opposed width-defining parallel of magnitude L, and said curved edges are of concave configuration drawn along a radius equal to $(6L/2\pi)$. along portions

5. A display frame construction for supporting a plurality of display sheet means, each sheet means being opposed, generally paralalel edges, said frame comprising opposed plates having respective slot-defining portions defining closed congruent slot patterns, each of said slot patterns having arcuate portions receiving one of said opposed edges; a central planar portion of each plate being separated along a major portion of its periphery from contiguous plate web portions and disposed inwardly toward the opposite plate, each of said planar portions comprising an equilateral triangular portion separated from the plate web portion alone one side of said triangle and a major portion of each of the remaining sides of said triangular portions, each of said planar portions being attached to said plate web portion by connecting leg portionns oppositely disposed to the separated side, said planar portions being disposed substantially parallel to the surrounding web portions, and retractable means connected at opposite ends to said planar portions and urging said plates toward one another and against said edges to entrap the display sheet means therebetween and maintain said plates in spaced, generally parallel relationship.

6. The combination of claim 5 which includes sheets having two generally parallel edges mounted in said slot-defining portions.

7. The combination of claim 6 in which said sheets comprise light-diffusing sheets for support of display sheet means which are transparent.

8. The combination of claim 7 including a light source disposed in the interior thereof.

9. A display frame construction for supporting a plurality of display sheet means, each sheet means having opposed, generally parallel edges, said frame comprising opposed plates having respective slot-defining portions which define closed congruent slot patterns, each of said slot patterns having arcuate portions receiving one of said opposed edges of said display sheet means, means maintaining said plates in spaced, generally parallel relationship comprising spacer means extending between said plates, releasable interlocking means connecting the spacer means to each of said plates, and retractable means urging said plates toward one another and against said edges to entrap the display sheet means therebetween.

10. The frame construction of claim 9 in which attachment means are mounted in inner center portions of said plates and said retractable means enage said attachment means under tension to urge said plates toward said spacer means and toward each other.

11. A display frame construction for supporting a plurality of display sheet means, each sheet having opposed, generally parallel edges, said frame comprising opposed plates having respective slot-defining portions which follow the contour of the plate edges and define closed congruent slot patterns, each of said slot patterns having arcuate portions receiving one of said opposed edges and forming a closed pattern, retractable means urging said plates toward one another and againt said sheet edges, and elongate spacer means having end portions which interfit in opposed portions of said plates, said spacer means maintaining said plates in spaced, generally parallel relationship, said retractable means being operatively connected to each of said plates so as to assist said spacer means in maintaining said plates in spaced, generally parallel relationship with said display sheet means therebetween.

12. A display frame construction for supporting a plurality of display sheet means, each sheet having opposed, generally parallel edges, said frame comprising opposed plates having respective slot-defining portions which follow the contour of the plate edges and define closed congruent slot patterns, said plate edges comprising three concave curves meeting at points defining first apices of a first equilateral triangle, said curves having radii centered at apices of a second equilaterial triangle tangent on each side to a circle passing through said first apices, said curves bisecting the sides of said second equilateral triangle, each of said slot patterns having arcuate portions receiving one of said opposed edges and forming a closed pattern, and retractable means urging said plates toward one another and against said edges to entrap the display sheet means therebetween whereby said retractable means is operatively connected to each of said plates and maintains said plates in spaced generally parallel relationship with said display means lockingly disposed therebetween to form a display assembly.

13. A display frame construction for supporting a plurality of display sheet means, each sheet having opposed, generally parallel edges, said frame comprising opposed plates having respective slot-defining portions which follow the contour of the plate edges and define closed congruent slot patterns, said plate edges being convexly curved, each of said slot patterns having arcuate portions receiving one of said opposed edges and forming a closed pattern, and retractable means urging said plates toward one another and against said edges to entrap the display sheet means therebetween whereby said retractable means is operatively connected to each of said plates and maintains said plates in spaced, generally parallel relationship with said display means lockingly disposed therebetween to form a display assembly.

14. A display frame construction for supporting a plurality of display sheet means, each sheet comprising opposed, generally parallel edges, said frame comprising opposed plates having respective slot-defining portions which follow the contour of the plate edges and define closed congruent slot patterns, each of said slot patterns having arcuate portions receiving one of said opposed edges, said plate slots being defined by the outermost periphery of said plates and inwardly spaced vertical ribs having the same contour as the plate outer peripheral portions from which they are spaced, and retractable means urging said plates toward one another and against said edges to entrap the display sheet means therebetween whereby said retractable means is operatively connected to each of said plates and maintains said plates in spaced, generally parallel relationship with said display means lockingly disposed therebetween to form a display assembly.

* * * * *

UNITED STATES PATENT OFFICE

CERTIFICATE OF CORRECTION

Patent No. 3,952,437 Dated April 27, 1976

Inventor(s) Robert W. Mitchell

It is certified that error appears in the above-identified patent and that said Letters Patent are hereby corrected as shown below:

Column 2, line 46, "rest" should be --rests--

Column 4, line 24, "engage" should be --with--

Column 5, line 55, "parallel" should be --edges--

Column 5, line 57, cancel "along portions" after the period at the end of the claim.

Column 5, line 60, "being" should be --having--

Column 5, line 60, "paralalel" should be --parallel--

Column 6, line 2, "alone" should be --along--

Column 6, line 5, "portionns" should be --portions--

Column 6, line 38, "enage" should be --engage--

Column 6, line 50, "againt" should be --against--

Signed and Sealed this

Twenty-second Day of March 1977

[SEAL]

*Attest:*

RUTH C. MASON
*Attesting Officer*

C. MARSHALL DANN
*Commissioner of Patents and Trademarks*